US005499806A

United States Patent [19]

Bourg

[11] Patent Number: 5,499,806

[45] Date of Patent: Mar. 19, 1996

[54] COLLATING MACHINE

[76] Inventor: Christian-P. Bourg, Rue de Blanmont 5, 1435 Hevillers, Belgium

[21] Appl. No.: 220,533

[22] Filed: Mar. 29, 1994

[30] Foreign Application Priority Data

Apr. 7, 1993 [FR] France ..... 93 04122

[51] Int. Cl.[6] ..... B65H 3/44; B65H 5/26

[52] U.S. Cl. ..... 271/9.11; 271/9.13; 271/12; 271/94; 271/98; 271/105; 271/31

[58] Field of Search ..... 271/9, 11, 12, 271/94, 96, 98, 104, 105, 30.1, 31, 9.11, 9.13; 270/58

[56] References Cited

U.S. PATENT DOCUMENTS

| | | | |
|---|---|---|---|
| 2,821,384 | 1/1958 | Mendes . | |
| 3,395,913 | 8/1968 | Del Vecchio et al. | 270/58 |
| 3,881,717 | 5/1975 | Dean | 270/58 |
| 4,363,584 | 12/1982 | Kokubo | 271/9 |
| 4,428,501 | 1/1984 | Osako | 271/9 |
| 4,518,158 | 5/1985 | Goi | 271/12 |
| 4,678,176 | 7/1987 | Roller | 271/94 |
| 5,052,675 | 10/1991 | Shehata et al. | 271/98 |
| 5,090,676 | 2/1992 | Matsuno et al. | 271/12 |

FOREIGN PATENT DOCUMENTS 0465062 1/1992 European Pat. Off. .

*Primary Examiner*—H. Grant Skaggs
*Attorney, Agent, or Firm*—Sixbey, Friedman, Leedom & Ferguson; Gerald J. Ferguson, Jr.; Tim L. Brackett, Jr.

[57] ABSTRACT

The collating machine comprises a frame (10), a plurality of superposed trays (20) in the frame in order to be loaded with stacks of paper (28), each tray (20) being fitted with an individual sheet ejection device and a transfer device, and a vertical conveyor (26) adjacent to the transfer devices of the trays (20) to receive, by the intermediary of the transfer devices, sheets ejected from their trays and to move the same to a collating station. The ejection device comprises several endless perforated tapes (34) carried on two spaced bend rolls (36 and 38) and a vacuum chamber (46) surrounded by the tapes (34) and having apertures, for the passage of air, distributed in its lower wall which is adjacent to the internal surface of the lower run (34*a*) of the tape (34). The opposite surface of the lower run of the tape (34) is positioned opposite to the top sheet (28*a*) in the stack in parallelism to the latter and at a distance which is maintained essentially constant by a moving plate (22) carrying the stack (28). FIG. 2.

7 Claims, 2 Drawing Sheets

COLLATING MACHINE

Figure 1:
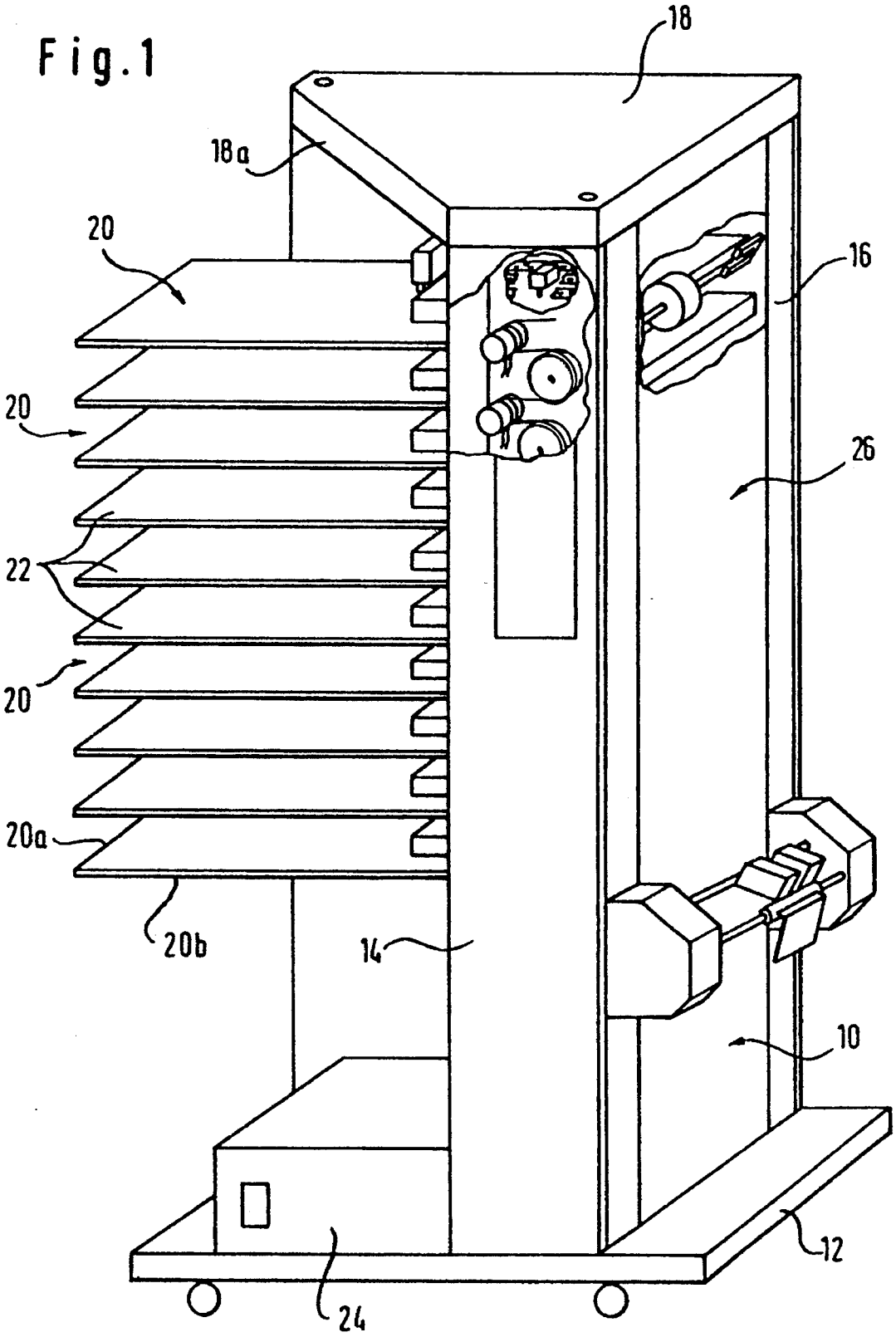

The invention relates to a collating machine and more particularly to a collating machine comprising a frame, a plurality of trays superposed within the frame to be charged with paper, each tray being equipped with an ejection device for the ejection of individual sheets and with a transfer device, and a vertical conveyor adjacent to the transfer devices of the trays in order to receive, by the intermediary of the transfer devices, sheets ejected from their trays and to move the same to a collating station.

In known collating machines of this type the ejection device of each tray possesses a pivotal arm which has a suction head at its end adjacent to the leading edge of the sheets. In each ejection cycle the suction head approaches the surface of the top sheet to aspirate it. Then the suction head together with the leading edge of the sheet is lifted by pivoting of the lever and the leading edge of the sheet is directed between a driven, rotary roll and a nip roll. As soon as the sheet is gripped between the nip roll and the driven roll it is moved forwards towards the vertical conveyor and deflected in parallelism to the latter in order to then be conveyed to a collating station.

Vertical collating machines, in which the trays are in fact superposed in the frame, offer the advantage that they only take up a small floor area. The passage of each sheet from the horizontal or slightly sloping position in the tray into the vertical position on the conveyor however implies a complex movement along a path which comprises a point of inflection and turning through an angle which may exceed 90°. The sheet is consequently sharply bent around a transverse axis thereof. In order not to impair the efficiency of the machine owing to such difficulties, it is necessary to reduce the speed of operation. Furthermore the range of papers which can be handled with such a collating machine is limited because the sheets must be sufficiently stiff in order not to bend excessively when they are lifted by one or several suction heads, while having to be sufficiently supple in order to only present a slight resistance to bending around their transverse axes.

In the collating machine in accordance with the invention these difficulties are avoided to a great extent. In accordance with the invention the ejection device comprises at least one endless perforated tape mounted on two spaced bend rolls and a vacuum chamber surrounded by the tape and having air passage apertures distributed in the lower wall, which is adjacent to the internal surface of the lower run of the tape, the opposite surface of the lower run of the tape being positioned opposite to the top sheet in the stack parallel to the latter and a distance which is maintained essentially constant by a moving table on which the stack rests. The perforated tape assumes a triple function: firstly separating, by suction, the top sheet in the stack, secondly as the sheet is thrust along essentially its entire length against the lower run of the tape, the sheet is maintained in a horizontal position prior to being offered to the transfer device adapted to move it to the vertical conveyor, and thirdly it has the function of moving the sheet, while still in the horizontal position, forward to the transfer device. Thus the path of the sheet is made up of a first phase in which it is lifted while still remaining in a horizontal position, at least in its part which is presented last to the transfer device, a second phase in which it is moved forward toward the vertical conveyor while maintaining its horizontal position, a third phase in which it is bent and turned around in order to be aligned with the vertical conveyor and a fourth phase comprising removal by the conveyor in a vertical plane. As compared with known collating machines, this path is more direct and entails less bending of the sheet, more particularly during the critical phase of separation of the top sheet and its passage to transfer device. This further development ha made it possible to increase the rate of operation of the collating machine in an astonishing fashion for a given paper quality. Moreover, the range of paper types which can be handled by the collating machine may be increased to be considerably greater than is the case with known collating machines. In fact it is now possible to successfully handle stiffer types of paper or even boards. A further surprising advantage of the collating machine is that it is able to handle papers of different widths, whose width even considerably exceeds the width of the perforated tape. The collating machine in accordance with the invention hence possesses a great flexibility as regards the quality and the dimensions of the paper, a greater efficiency and a lower space requirement owing to the superposition of the trays.

The transfer device is preferably constituted by a drive roll, which is caused to permanently rotate, and at least one nip roll, the nip formed between the drive roll and the nip roll being essentially positioned in the plane of the lower run of the perforated tape. Thus, a short distance following the clearance of the leading edge from the perforated tape, it is engaged by the driving roll and by the nip roll. As from this instant the movement of the sheet is positively controlled as regards its path and its synchronization with the movement of the other sheets.

In order to reduce to a minimum the number of passages of the sheet from one conveying mechanism to another, the periphery of the driving roll is preferably adjacent to a vertical belt of the conveyor whose surface opposite to the driving roll is supported on a support roll, a deflection element being associated with the periphery of the driving roll in order to direct the leading edge of the sheet moved forward by the conveying roll, into a gap formed between the latter and the belt of the conveyor.

In order to minimize any tendency of the sheet to laterally drift out of its path the invention contemplates an arrangement wherein the ejection device, the transfer device and the conveyor are operated in such a manner that a sheet—separated from its stack and adhering by suction to the lower surface of the tape, moved forwards by the tape to the transfer device, loaded in the latter and moved toward the conveyor—still adheres to the tape at least at its trailing edge at the instant of being loaded onto the conveyor. One of the problems which has to be mastered in a collating machine is that of efficient separation of a sheet from its stack or pile. This problem is more especially relevant in the case of the utilization of perforated tapes for aspiration of the sheet, since the ascending air current so created tends to pull up more than one sheet at a time. In order to remedy this disadvantage there is a provision in accordance with the invention such that an air current is directed into a space provided between the lower surface of the perforated tape and the surface of the top sheet in the stack, aspirated toward the tape, by at least one annular separating element which extends parallel to the tape and whose thickness is greater than that of the tape in such a manner as to cause a local displacement of the sheet which is aligned with the longitudinal direction of the same. Preferably, the separating element is constituted by an endless belt fitted around the two bend rolls.

Further details and particular features of the invention will appear from the following description with reference to the accompanying drawings.

FIG. 1 diagrammatically shows a collating machine having superposed trays.

Figure 2:
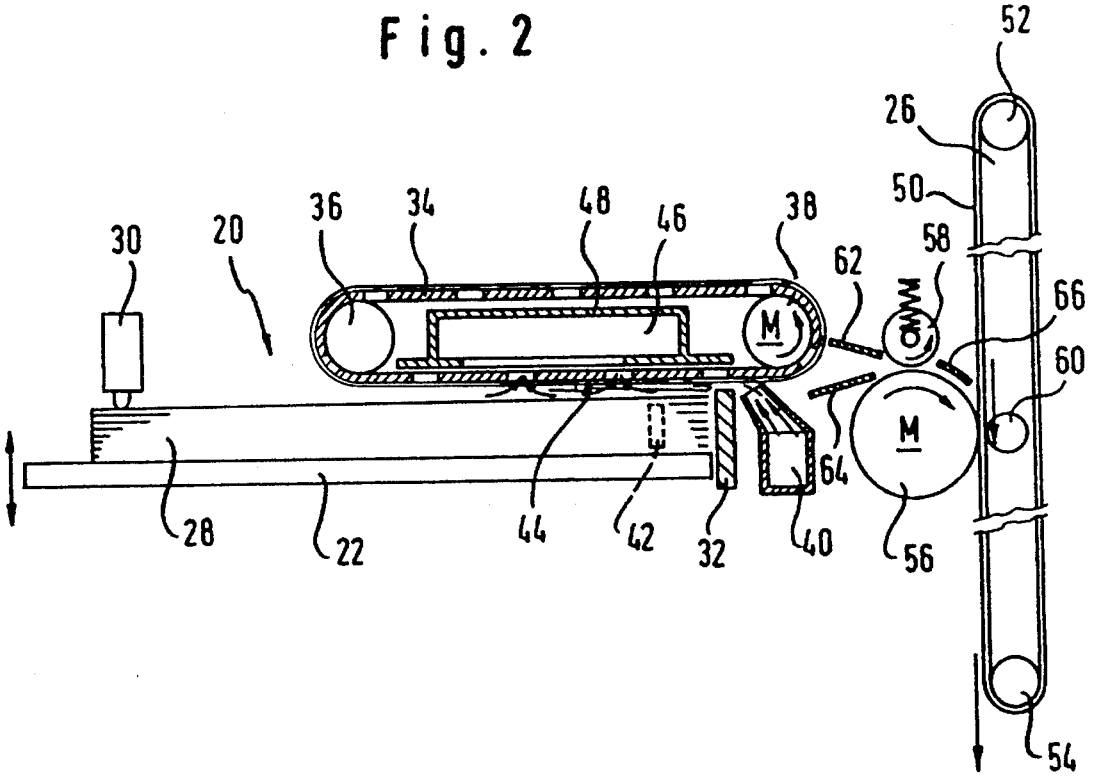

FIG. 2 is a diagrammatic and partly sectioned elevation of a device for the ejection and transfer of sheets separated from a stack.

Figure 3:
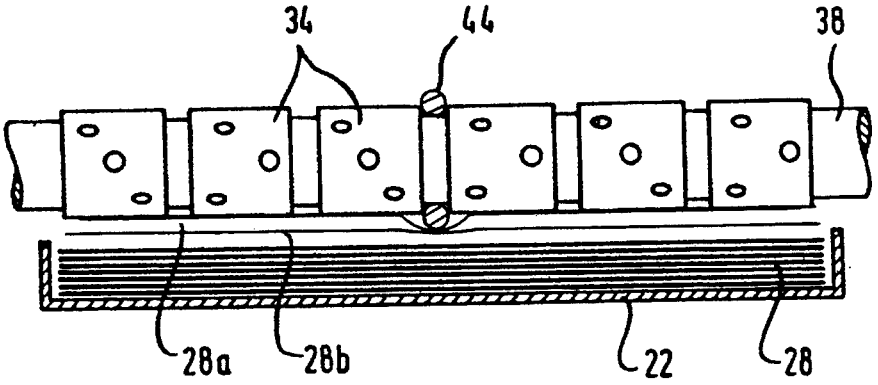

FIG. 3 diagrammatically illustrates a detail of the ejection device.

The collating machine diagrammatically represented in FIG. 1 comprises a frame with a generally prismatic configuration. The frame 10 comprises a base 12, mounted on wheels, an upright 14 and a vertical wall 16, the upper ends of the upright 14 and of the wall 16 being connected together by a cover 18. The base 12 possesses a rectangular configuration and the cover 18 has a polygonal form similar to a rectangle of which one apex is truncated to constitute an oblique side 18*a*. In the space underneath this side 18*a* a plurality of superposed trays 20 are arranged which are to be loaded with stacks of paper. These trays 20 are identical to one another and each comprises a vertically moving or adjustable plate 22 on which the stacks of paper are carried. The plates 22 extend laterally out of the space underneath the cover 18 and possibly past the projection of the base 12. Thus the trays 20 are in fact freely accessible from at least two sides 20*a* and 20*b* of the collating machine.

The base 12 bears a casing 24 in which several mechanisms are operated for controlling and driving the collating machine. In the space comprised between the upright 14 and the wall 16, on the side opposite to the trays 20, a vertical conveyor 26 is operated whose function consists in removing the ejected sheets from their trays 20 toward an assembly unit, which will not be described because it does not constitute part of the invention.

Each tray 20 possesses an individual sheet ejection device which will be now described with reference to FIG. 2.

In FIG. 2 the reader will perceive the movable plate 22 on which there rests a stack 28 of paper. A sensor 30 is provided to detect the level of the top sheet in the stack 28 in order to generate a control signal as soon as the level of the top sheet has been lowered by a predetermined amount. This control signal causes the operation of a lifting mechanism, not illustrated, which raises the plate 22 responsive to the control signal in such a manner that an essentially constant level of the top sheet in the stack 28 is maintained.

The leading or front edge of each sheet in the stack 28 is in engagement with a stationary abutment 32 which extends as far as a level slightly above the level of the top sheet in the stack 28.

Several endless perforated tapes 34 are trained around two bend rolls 36 and 38, whose axes are spaced out in the same horizontal plane. The roll 36 is adapted to operate as an idler roll whereas the roll 38 is selectively rotated by the operation of a clutch mechanism arranged in the interior of the upright 14 as is diagrammatically indicated in FIG. 1. The lower run 34a of each perforated tape 34 is positioned in a plane in parallelism to that of the top sheet in the stack 28 and at a substantially constant distance of approximately 10 mm therefrom. One or more nozzles 40 are provided in order to direct an air current into the space underneath the lower run 34*a* of the perforated tapes 34, such current moving past the upper edge of the abutment 32. Additionally, lateral and/or front apertures 42 render possible a blowing of air onto the end of the stack 28 in order to cause an initial separation of the sheets.

As will be seen from FIG. 3, which is a detailed view of the moving plate 22, the bend roll 38 and a total number of six perforated tapes 34 arranged in parallel to one another with a small space between them, an endless belt 34 with a circular cross section is also trained about the rolls 36 and 38 in the middle of the perforated tapes 34. The diameter of the cross section of this belt 44 is greater than the thickness of the perforated tapes 34, as will also be perceived from FIG. 3.

A vacuum chamber 46 is defined by a casing 48 arranged in the space surrounded by the perforated tapes 34. The casing 48, whose inner space is selectively put in communication with a suction or aspiration device, possesses, at its face adjacent to the lower run 30*a* of the perforated tapes 34, air passage apertures distributed in a manner adapted for aspiration of the top sheet through apertures in the perforated tapes 34 and the gaps existing between the adjacent edges thereof.

The vertical conveyor comprises one or more endless belts 50 mounted on two bend rolls 52 and 54, whose axes are spaced out in vertical plane and of which one, preferably the roll 54, is driven. In the space comprised between each tray 20 and the conveyor 26 a transfer device is arranged which is made up of a drive roll 56 driven for constant rotation and a nip roll 58 acted upon by a spring in contact with the periphery of the driving roll 56. The belt 50 is tangentially in contact with the periphery of each driving roll 56 and the opposite surface of the belt engages a support roll 60. Sheet metal guides 62 and 64 are provided upstream from the driving roll 56 in order to ensure a regular motion or passage of the leading edge of a sheet, moved forward by the perforated tapes 34, into the nip defined between the periphery of the roll 54 and that of the nip roll 58. A deflecting sheet metal guide 66 is provided downstream from the driving roll 56 in order to ensure the deflection of the leading edge of a sheet moved forward by the driving roll 56 toward the vertical path of the conveyor 26.

In operation an appropriate number of trays 20 is charged with stacks of paper. The collating machine operates in successive collating cycles in accordance with a program generated by a control unit, which does not constitute a part of the invention and which will hence not be described in detail. The plates 22 of the trays loaded with the stacks are arranged at a suitable level in order to ensure that the top sheet of the stack is at a predetermined distance, amounting to approximately 10 mm for instance, from the lower run 34*a* of the perforated tapes 34. Then the vacuum chamber 45 is switched into communication with a vacuum source. Simultaneously blowing air is supplied to the nozzles 40 and the apertures 43 in order to facilitate the separation of the sheets. The top sheet 28*a* of the stack 28 (see FIG. 3) is aspirated through the apertures in the perforated tapes 34, detaches itself from the stack 28 and assumes a position on the lower surface of the run 34*a* of the tapes 34. In this position, as will be seen from FIG. 3, the belt 44 causes a local displacement of the sheet 28*a* in alignment with the horizontal direction of the sheet 28*a*. Thus a space is produced between the lower surface of the sheet 28*a* and the opposite surface of the following sheet 28b of the stack 28 and an air current is directed into this space by the nozzles 40. This air current causes an efficient separation of the sheets 28*a* and 28*b* in the vertical direction. Then, when the bend rolls 36 and 38 are caused to rotate by the clutch the top sheet 28*a* ia moved forwards toward the driving roll 56, the following sheet 28*b* is prevented from being moved, since its leading edge rests against the abutment 32, whose height exceeds the level of the lower run of the belt 44. The sheet 28*b*, even although it is as well lifted by the suction effect, is therefore positively halted by the abutment 32. It will consequently be clear that the ejection device ensures an extremely efficient separation of the sheets in the stack 28.

The top sheet, which has thus been separated, is now in a position applied to the opposite surface of the lower run 34*a* of the perforated tapes 34 and is hence positioned in a horizontal plane prior to being presented to the nip between the drive roll 56 and the nip roll 58, which is essentially in the same horizontal plane. As soon as the leading edge of the sheet moves into this gap, the sheet is positively engaged and moved forward by the transfer device constituted by the roll 56 and the roll 58. Then the leading edge of the sheet is sloped downward by the sheet metal deflecting guide 66 and comes against the belt 50 in order to then be engaged in the nip formed between the latter and the periphery of the roll 56. Owing to the composite action of the driving roll 56 and of the belt 50 moved by rotation of the bend rolls 52 and 54, the sheet is then engaged by the conveyor 26 in the transferred to the collating station. As soon as the sheets are engaged by the vertical conveyor 26 the communication between the vacuum chamber 46 and the vacuum source is interrupted in such a manner that the suction effect ceases. Simultaneously or somewhat later the drive for the perforated tapes 34 is turned off in order to avoid premature advance of the following sheet.

In the following cycles the same operations are repeated.

I claim:

1. A collating machine comprising a frame, a plurality of superposed trays in said frame to be loaded with stacks of horizontally aligned sheet of paper, each tray comprising a vertically movable bottom plate and being associated with a device for the ejection of individual sheets and with a transfer device, and a conveyer adjacent to said transfer devices to receive sheets ejected by one of said ejection devices and transferred by the associated transfer device to move each sheet downwardly along said conveyer in an at least substantially vertical direction, wherein each of said ejection devices comprises at least one endless perforated tape, a pair of spaced rolls, and a vacuum chamber surrounded by said tape and having a lower wall wherein apertures for the passage of air are distributed, said lower wall being adjacent to an internal surface portion of a lower run of said tape, said lower tape run having an outer surface portion positioned opposite to a top sheet in a stack of paper in parallelism to said top sheet and at a distance which is maintained essentially constant by said vertically movable bottom plate, said transfer device including a driving roll and at least one nip roll, a nip defined between said driving roll and said nip roll being essentially positioned in a plane defined by said lower run of the perforated tape, said driving roll having a periphery adjacent to a conveyor belt of said conveyor, said conveyor belt having a surface opposite to said driving roll and rested on a support roll, and a deflecting element being associated with the periphery of said driving roll downstream of said nip roll and upstream from said conveyor belt to direct the leading edge of a sheet moved forward by said driving roll, downwardly into a nip defined between the periphery of said driving roll and said conveyor belt.

2. A collating machine comprising a frame, a plurality of superposed trays in said frame to be loaded with stacks of horizontally aligned sheet of paper, each tray comprising a vertically movable bottom plate and being associated with a device for the ejection of individual sheets and with a transfer device, and a conveyor adjacent to said transfer devices to receive sheets ejected by one of said ejection devices and transferred by the associated transfer device to move each sheet downwardly along said conveyor in an at least substantially vertical direction, wherein each of said ejection devices comprises at least one endless perforated tape, a pair of spaced rolls, said tape engaging around and being supported by said rolls, and a vacuum chamber surrounded by said tape and having a lower wall wherein apertures for the passage of air are distributed, said lower wall being adjacent to an internal surface portion of a lower run of said tape, said lower tape run having an outer surface portion positioned opposite to a top sheet in a stack of paper in parallelism to said top sheet and at a distance which is maintained essentially constant by said vertically movable bottom plate, wherein said transfer device and said conveyor are so operated that a sheet, separated from its stack, held by aspiration on the outer surface portion of said lower tape run, moved forward by said tape toward said transfer device and transferred to said conveyor, is still held on said tape, at least at its trailing edge, at an instant at which it is loaded onto said conveyor.

3. A collating machine comprising a frame, a plurality of superposed trays in said frame to be loaded with stacks of horizontally aligned sheet of paper, each tray comprising a vertically movable bottom plate and being associated with a device for the ejection of individual sheets and with a transfer device, and a conveyor adjacent to said transfer devices to receive sheets ejected by one of said ejection devices and transferred by the associated transfer device to move each sheet downwardly along said conveyor in an at least substantially vertical direction, wherein each of said ejection devices comprises at least one endless perforated tape, a pair of spaced rolls, said tape engaging around and being supported by said rolls, and a vacuum chamber surrounded by said tape and having a lower wall wherein apertures for the passage of air are distributed, said lower wall being adjacent to an internal surface portion of a lower run of said tape, said lower tape run having an outer surface portion positioned opposite to a top sheet in a stack of paper in parallelism to said top sheet and at a distance which is maintained essentially constant by said vertically movable bottom plate, said frame having an open side and said trays projecting laterally out of said open side.

4. The collating machine as claimed in claim 3, wherein said frame has a generally prismatic configuration and said conveyor is arranged along one side of said frame, said trays being arranged on an opposite side of said frame.

5. A collating machine comprising a frame, a plurality of superposed trays in said frame to be loaded with stacks of horizontally aligned sheet of paper, each tray comprising a vertically movable bottom plate and being associated with a device for the ejection of individual sheets and with a transfer device, and a conveyor adjacent to said transfer devices to receive sheets ejected by one of said ejection devices and transferred by the associated transfer device to move each sheet downwardly along said conveyor in an at least substantially vertical direction, wherein each of said ejection devices comprises at least one endless perforated tape, a pair of spaced rolls, said tape engaging around and being supported by said rolls, and a vacuum chamber surrounded by said tape and having a lower wall wherein apertures for the passage of air are distributed, said lower wall being adjacent to an internal surface portion of a lower run of said tape, said lower tape run having an outer surface portion positioned opposite to a top sheet in a stack of paper in parallelism to said top sheet and at a distance which is maintained essentially constant by said vertically movable bottom plate, an air current being directed into a space defined between a lower surface of a top sheet in each stack, held by suction against said perforated tape, and the upper surface of a following sheet on said stack and said space has a thickness defined by at least one annular separating element which extends in parallelism to said tape and whose thickness is greater than that of said tape in such a manner as to cause a local deformation of said top sheet which is in alignment with a longitudinal dimension of said sheet, and said separating element being formed by an endless belt trained around said pair of rolls.

6. The collating machine as claimed in claim 5, wherein a plurality of perforated tapes are trained around said rolls and extend in parallel to each other with a small spacing between them, said endless belt being arranged essentially in the middle of said tapes.

7. The collating machine as claimed in claim 5, wherein an air current is directed at least onto lateral surfaces of each stack in order to assist separation of sheets.

* * * * *